US006133832A

United States Patent [19]

Winder et al.

[11] Patent Number: 6,133,832

[45] Date of Patent: Oct. 17, 2000

[54] ARTICLE LOCATION SYSTEM

[76] Inventors: Jeffrey S. Winder; Eileen L. Ballenger, both of 3212 38th St., Metairie, La. 70001

[21] Appl. No.: 09/176,874

[22] Filed: Oct. 22, 1998

[51] Int. Cl.[7] ..... G08B 13/14

[52] U.S. Cl. ..... 340/572.1; 340/825.44

[58] Field of Search ..... 340/572.1, 825.44, 340/825.34, 825.36, 825.54

[56] References Cited

U.S. PATENT DOCUMENTS

| | | | |
|---|---|---|---|
| 4,804,943 | 2/1989 | Soleimani | 340/539 |
| 4,904,983 | 2/1990 | Mitchell | 340/426 |
| 5,126,719 | 6/1992 | DeSorbo | 340/571 |
| 5,172,110 | 12/1992 | Tiefengraber | 340/825.49 |
| 5,245,314 | 9/1993 | Kah, Jr. | 340/539 |
| 5,294,915 | 3/1994 | Owen | 340/539 |
| 5,299,227 | 3/1994 | Rose | 340/825.44 |
| 5,331,325 | 7/1994 | Miller | 341/176 |
| 5,598,143 | 1/1997 | Wentz | 340/539 |
| 5,640,144 | 6/1997 | Russo et al. | 340/568 |
| 5,648,757 | 7/1997 | Vernace et al. | 340/539 |
| 5,673,023 | 9/1997 | Smith | 340/571 |
| 5,673,035 | 9/1997 | Huang | 340/825.44 |
| 5,677,673 | 10/1997 | Kipnis | 340/539 |
| 5,680,105 | 10/1997 | Hedrick | 340/571 |
| 5,686,891 | 11/1997 | Sacca et al. | 340/571 |

*Primary Examiner*—Jeffery A. Hofsass
*Assistant Examiner*—John Tweel, Jr.
*Attorney, Agent, or Firm*—Joseph N. Breaux

[57] ABSTRACT

An article location system that includes a number of identical receiver tags that are attachable to articles and a transmitter assembly including a transmitter unit that transmits a predetermined coded radio signal to activate each receiver tag. Each receiver tag provides an audible and a visual output when activated. The visual output includes a moving pinpoint output beam generated by a laser diode.

4 Claims, 6 Drawing Sheets

20
16
24
40
36
28
26
30
42
32
44
50
52
18
48

FIG.4
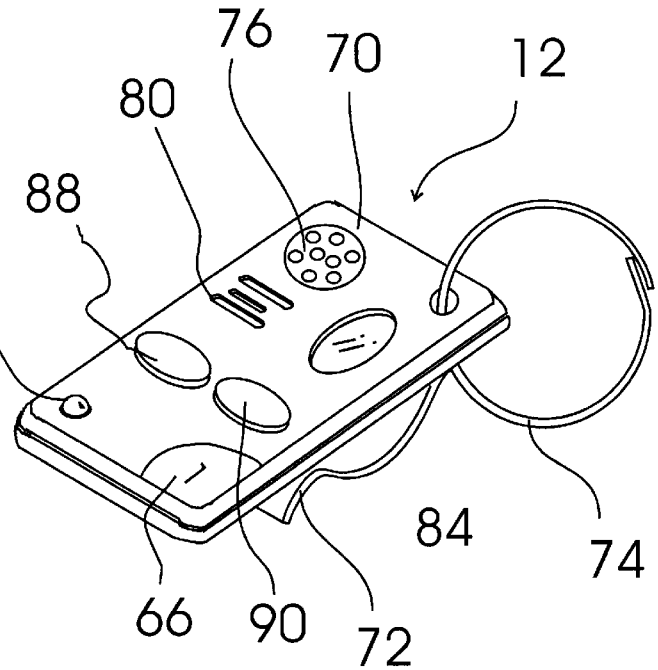
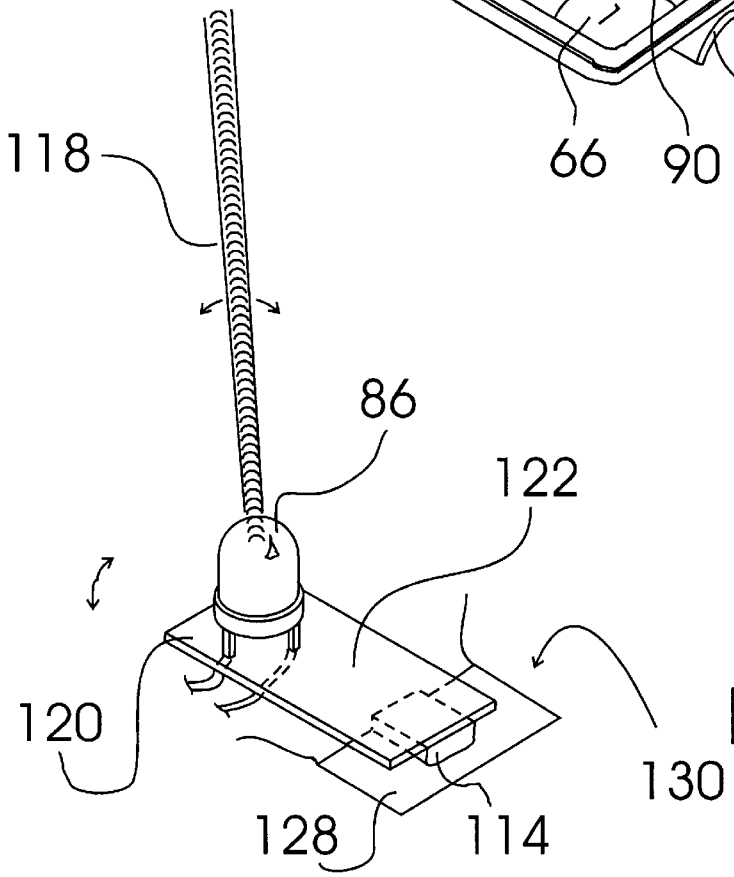
FIG.6

ARTICLE LOCATION SYSTEM

TECHNICAL FIELD

The present invention relates to article finding systems and more particularly to article location system that includes a number of identical receiver tags that are attachable to articles and a transmitter assembly including a transmitter unit that transmits a predetermined coded radio signal to activate each receiver tag; each receiver tag providing an audible and a visual output when activated, the visual output including a moving pinpoint output beam generated by a laser diode; the transmitter unit including a transmitter housing including a radio transmitter/control circuit having a radio frequency transmitter and being in connection with a main LCD interface display, an alphanumeric keypad, a scroll up button, a scroll down button, a select button, a microphone, a transmitter speaker, and a separate time/date display LCD; the radio transmitter/control circuit being in connection with the main LCD interface display, the alphanumeric keypad, the scroll-up button, the scroll-down button, the select button, the transmitter microphone, the transmitter speaker, the separate time/date display LCD, and the transmitter antenna; each of the number of identical receiver tags including a molded plastic tag housing a tag clip, a tag connecting ring, a tag speaker grate, a tag microphone grate, a laser diode window, a record function button, and a play function button; the molded plastic tag housing further including an internal compartment formed therein for housing a receiver/alerting circuit including a radio receiving circuit and an alerting circuit triggered by an output of the radio receiving circuit; the radio receiving circuit having a decoding/select circuit tuned to the transmission frequency of the radio frequency transmitter circuit of the radio transmitter/control circuit; the decoding/select circuit decoding the radio transmissions from the radio frequency transmitter circuit of the radio transmitter/control circuit and activating an alerting circuit activation output when a predetermined signal pattern is decoded; the alerting circuit activating a tag speaker drive circuit in connection with a tag speaker that can emit a user recorded message or a predetermined alarm sound; a laser diode drive circuit in connection with a laser diode having a pinpoint output beam aimed through a diode window provided in the plastic tag housing; a laser diode movement structure including a piezo crystal positioned between a base substrate and a laser diode support plate upon which the laser diode is mounted; and a laser diode movement structure drive circuit including the piezo crystal positioned between the base substrate and the laser diode support plate on which the laser diode is mounted such that electrically induced vibrations of the piezo crystal cause the laser diode support plate to vibrate resulting in movement of the pinpoint output beam of the laser diode in a manner to aid a person searching for the article to which the receiver tag is attached to visually identify the location of the receiver tag; the radio receiving circuit being in connection with the receiving antenna; the decoding/select circuit in input receiving connection with the receiving circuit output of the receiving circuit; the alerting circuit being in receiving connection with alerting circuit activation output of the decoding/select circuit; the audio drive circuit being in input receiving connection with the alerting circuit, the record function button, the play function button and the tag microphone, and in output connection with the tag speaker; the laser diode drive circuit being in input receiving connection with the alerting circuit and in output connection with the laser diode; and the laser diode movement strcuture drive circuit being in driving connection with the piezo crystal of the laser diode movement structure that is positioned between the base substrate and the laser diode support plate.

BACKGROUND ART

It can be bothersome and time consuming when at home to search for items such as keys, wallets, remote controls etc. that have been mislaid. In addition, at business locations such as offices, warehouses and the like, many valuable employee hours are lost each year searching for mislaid files, equipment, merchandise and the like. It would be a benefit, therefore, to have a system for locating these articles that included a number of receiver units that would each be attached to an article and a transmitter that activated any particular receiver causing the activated receiver to generate an audible and/or a visual output to aid in locating the article to which the receiver unit was attached.

GENERAL SUMMARY DISCUSSION OF INVENTION

It is thus an object of the invention to provide an article location system that includes a number of receiver units that are each attachable to an article and a transmitter that activates any particular receiver causing the activated receiver to generate an audible and/or a visual output to aid in locating the article to which the receiver unit is attached.

It is a further object of the invention to provide an article location system that includes a number of identical receiver tags that are attachable to articles and a transmitter assembly including a transmitter unit that transmits a predetermined coded radio signal to activate each receiver tag; each receiver tag providing an audible and a visual output when activated; the visual output including a moving pinpoint output beam generated by a laser diode; the transmitter unit including a transmitter housing including a radio transmitter/control circuit having a radio frequency transmitter and being in connection with a main LCD interface display, an alphanumeric keypad, a scroll up button, a scroll down button, a select button, a microphone, a transmitter speaker, and a separate time/date display LCD; the radio transmitter/control circuit being in connection with the main LCD interface display, the alphanumeric keypad, the scroll-up button, the scroll-down button, the select button, the transmitter microphone, the transmitter speaker, the separate time/date display LCD, and the transmitter antenna; each of the number of identical receiver tags including a molded plastic tag housing a tag clip, a tag connecting ring, a tag speaker grate, a tag microphone grate, a laser diode window, a record function button, and a play function button; the molded plastic tag housing further including an internal compartment formed therein for hosing a receiver/alerting circuit including a radio receiving circuit and an alerting circuit triggered by an output of the radio receiving circuit; the radio receiving circuit having a decoding/select circuit tuned to the transmission frequency of the radio frequency transmitter circuit of the radio transmitter/control circuit; the decoding/select circuit decoding the radio transmissions from the radio frequency transmitter circuit of the radio transmitter/control circuit and activating an alerting circuit activation output when a predetermined signal pattern is decoded; the alerting circuit activating a tag speaker drive circuit in connection with a tag speaker that can emit a use recorded message or a predetermined alarm sound; a laser diode drive circuit in connection with a laser diode having a pinpoint output beam aimed through a diode window provided in the plastic tag housing; a laser diode movement structure including a piezo crystal positioned between a base substrate and a laser diode support plate upon which the laser diode is mounted; and a laser diode movement structure drive circuit including the piezo crystal positioned between the base substrate and the laser diode support plate on which the laser diode is mounted such that electrically induced vibrations of the piezo crystal cause the laser diode support plate to vibrate resulting in movement of the pinpoint output beam of the laser diode in a manner to aid a person searching for the article to which the receiver tag is attached to visually identify the location of the receiver tag; the radio receiving circuit being in connection with the receiving antenna; the decoding/select circuit in input receiving connection with the receiving circuit output of the receiving circuit; the alerting circuit being in receiving connection with alerting circuit activation output of the decoding/select circuit; the audio drive circuit being in input receiving connection with the alerting circuit, the record function button, the play function button and the tag microphone, and in output connection with the tag speaker; the laser diode drive circuit being in input receiving connection with the alerting circuit and in output connection with the laser diode; and the laser diode movement strcuture drive circuit being in driving connection with the piezo crystal of the laser diode movement structure that is positioned between the base substrate and the laser diode support plate; the radio frequency transmitter circuit of the radio transmitter/control circuit transmitting voice data generated by the microphone of the transmitter/control circuit to create a direct intercom link between the microphone of the transmitter/control circuit and the tag speaker of the selected receive tag.

It is a still further object of the invention to provide an article location system that accomplishes all of the above objects in combination.

Accordingly, an article location system is provided. The article location system includes a number of identical receiver tags that are attachable to articles and a transmitter assembly including a transmitter unit that transmits a predetermined coded radio signal to activate each receiver tag; each receiver tag providing an audible and a visual output when activated, the visual output including a moving pinpoint output beam generated by a laser diode; the transmitter unit including a transmitter hosing including a radio transmitter/control circuit having a radio frequency transmitter and being in connection with a main LCD interface display, a alphanumeric keypad, a scroll up button, a scroll down button, a select button, a microphone, a transmitter speaker, and a separate time/date display LCD; the radio transmitter/control circuit being in connection with the main LCD interface display, the alphanumeric keypad, the scroll-up button, the scroll-down button, the select button, the transmitter microphone, the transmitter speaker, the separate time/date display LCD, and the transmitter antenna; each of the number of identical receiver tags including a molded plastic tag housing a tag clip, a tag connecting ring, a tag speaker grate, a tag microphone grate, a laser diode window, a record function button, and a play function button; the molded plastic tag housing further including an internal compartment formed therein for housing a receiver/alerting circuit including a radio receiving circuit and an alerting circuit triggered by an output of the radio receiving circuit; the radio receiving circuit having a decoding/select circuit tuned to the transmission frequency of the radio frequency transmitter circuit of the radio transmitter/control circuit; the decoding/select circuit decoding the radio transmissions from the radio frequency transmitter circuit of the radio transmitter/control circuit and activating an alerting circuit activation output when a predetermined signal pattern is decoded; the alerting circuit activating a tag speaker drive circuit in connection with a tag speaker that can emit a user recorded message or a predetermined alarm sound; a laser diode drive circuit in connection with a laser diode having a pinpoint output beam aimed through a diode window provided in the plastic tag housing; a laser diode movement structure including a piezo crystal positioned between a base substrate and a laser diode support plate upon which the laser diode is mounted; and a laser diode movement structure drive circuit including the piezo crystal positioned between the base substrate and the laser diode support plate on which the laser diode is mounted such that electrically induced vibrations of the piezo crystal cause the laser diode support plate to vibrate resulting in movement of the pinpoint output beam of the laser diode in a manner to aid a person searching for the article to which the receiver tag is attached to visually identify the location of the receiver tag; the radio receiving circuit being in connection with the receiving antenna; the decoding/select circuit in input receiving connection with the receiving circuit output of the receiving circuit; the alerting circuit being in receiving connection with alerting circuit activation output of the decoding/select circuit; the audio drive circuit being in input receiving connection with the alerting circuit, the record function button, the play function button and the tag microphone, and in output connection with the tag speaker; the laser diode drive circuit being in input receiving connection with the alerting circuit and in output connection with the laser diode; and the laser diode movement structure drive circuit being in driving connection with the piezo crystal of the laser diode movement structure that is positioned between the base substrate and the laser diode support plate. In a preferred embodiment, the article location system also includes a simple receiver tags that include a radio receiving circuit coupled to a decode/select circuit that activates an audible alerting device housed within a slim line housing suitable for adhesive or clip attachment to business files and merchandise in warehouses that are inexpensive to manufacture.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 4 is a perspective view of one of the seven identical receiver tags of the article location system of the present invention showing the method plastic tag housing with the tag number, the tag clip, the tag connecting ring, the tag speaker grate, the tag microphone grate, the diode window, the record function button, the play function button, and the power indicator LED; the molded plastic tag hosing further including an internal compartment formed therein for housing a receiver/alerting circuit including a radio receiving circuit and an alerting circuit triggered by an output of the radio receiving circuit; the radio receiving circuit having a decoding/select circuit tuned to the transmission frequency of the radio frequency transmitter circuit of the radio transmitter/control circuit; the decoding/select circuit decoding the radio transmissions from the radio frequency transmitter circuit of the radio transmitter/control circuit and activating an alerting circuit activation output when a predetermined signal pattern is decoded; the alerting circuit activating a tag speaker drive circuit in connection with a tag speaker that can emit a user recorded message or a predetermined alarm sound; a laser diode drive circuit in connection with a laser diode having a pinpoint output beam aimed through a diode window provided in the plastic tag housing; and a laser diode movement structure drive circuit including a piezo crystal positioned between a base substrate and a laser diode support plate on which the laser diode is mounted such that vibrations of the piezo crystal cause the laser diode support plate to vibrate resulting in movement of the pinpoint output beam of the laser diode in a manner to aid a person searching for the article to which the receiver tag is attached to visually identify the location of the receiver tag.

FIG. 6 is a detail perspective view showing the laser diode movement structure including the piezo crystal positioned between the base substrate and the laser diode support plate upon which the laser diode is mounted.

EXEMPLARY MODE FOR CARRYING OUT THE INVENTION

Figure 1:
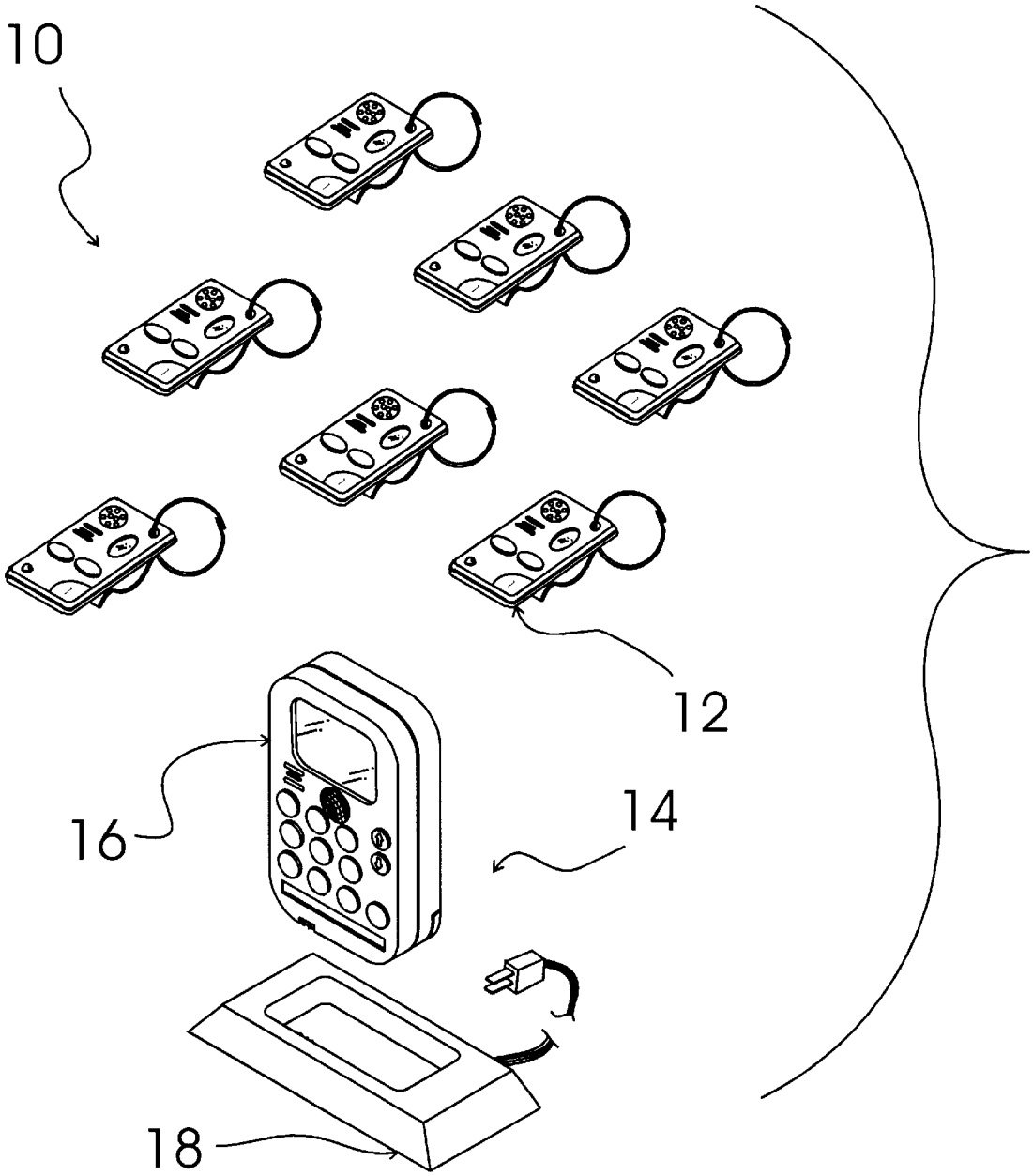
FIG. 1 shows an exemplary embodiment of the article location system of the present invention showing seven identical exemplary receiver tags and an exemplary transmitter assembly including an exemplary transmitter unit and an exemplary recharging base.

FIG. 1 shows an exemplary embodiment of the article location system of the present invention, generally designated 10, including seven identical exemplary receiver tags, generally designated 12, and an exemplary transmitter assembly, generally designated 14, including an exemplary transmitter unit, generally designated 16, and an exemplary recharging base, generally designated 18.

Figure 2:
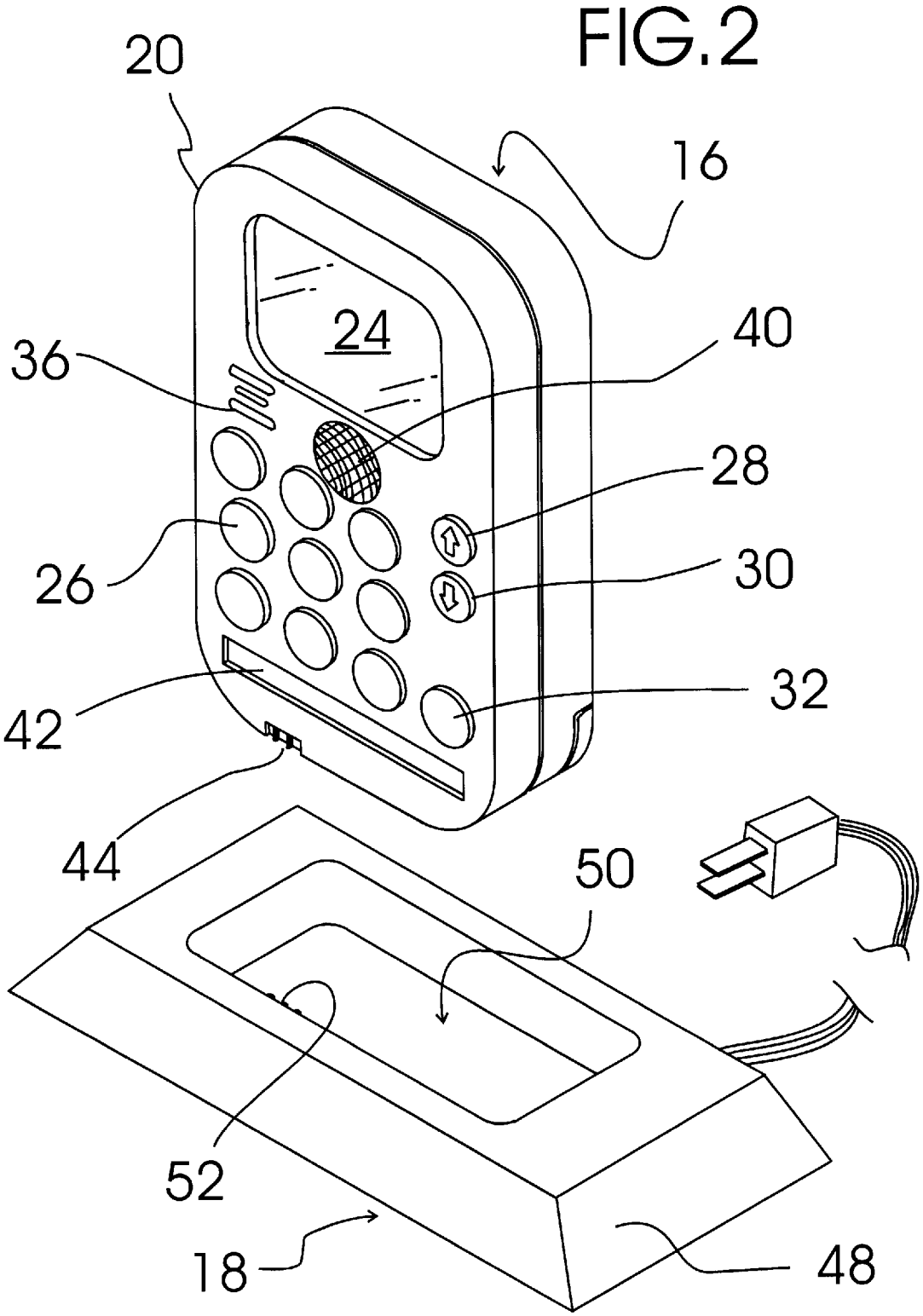
FIG. 2 is a perspective view of an exemplary transmitter assembly of the article location system of the present invention showing the transmitter unit and the recharging base; the transmitter unit including a transmitter housing including a radio transmitter/control circuit having a radio frequency transmitter and being in connection with the main LCD interface display, the alphanumeric keypad, the scroll up button, the scroll down button, the select button, the microphone, the transmitter speaker, the separate time/date display LCD, and the transmitter recharging connector; the recharging base including a charging circuit positioned within a base housing having a receiving cavity including a base recharging connecter keyed such that when a bottom section of the transmitter housing is inserted into the receiving cavity, the base recharging connector and the transmitter recharging connector make contact.

With reference to FIG. 2, transmitter unit 16 includes a molded plastic transmitter housing 20 housing a radio transmitter/microprocessor control circuit, generally designated 22 (see FIG. 3) having a radio frequency transmitter and being in connection with a main LCD interface display 24, an alphanumeric keypad 26, a scroll up button 28, a scroll down button 30, a select button 32, a microphone 34 (FIG. 3) positioned behind a microphone grate 36, a transmitter speaker 38 (FIG. 3) positioned behind a speaker grate 40, a separate time/date display LCD 42, and a transmitter recharging connector 44.

Recharging base 18 includes a conventional charging circuit positioned within a base housing 48 having a receiving cavity 50 including a base recharging connector 52 keyed such that when a bottom section of transmitter housing 20 is inserted into receiving cavity 50, base recharging connector 52 and transmitter recharging connector 44 make electrical connection.

Figure 3:
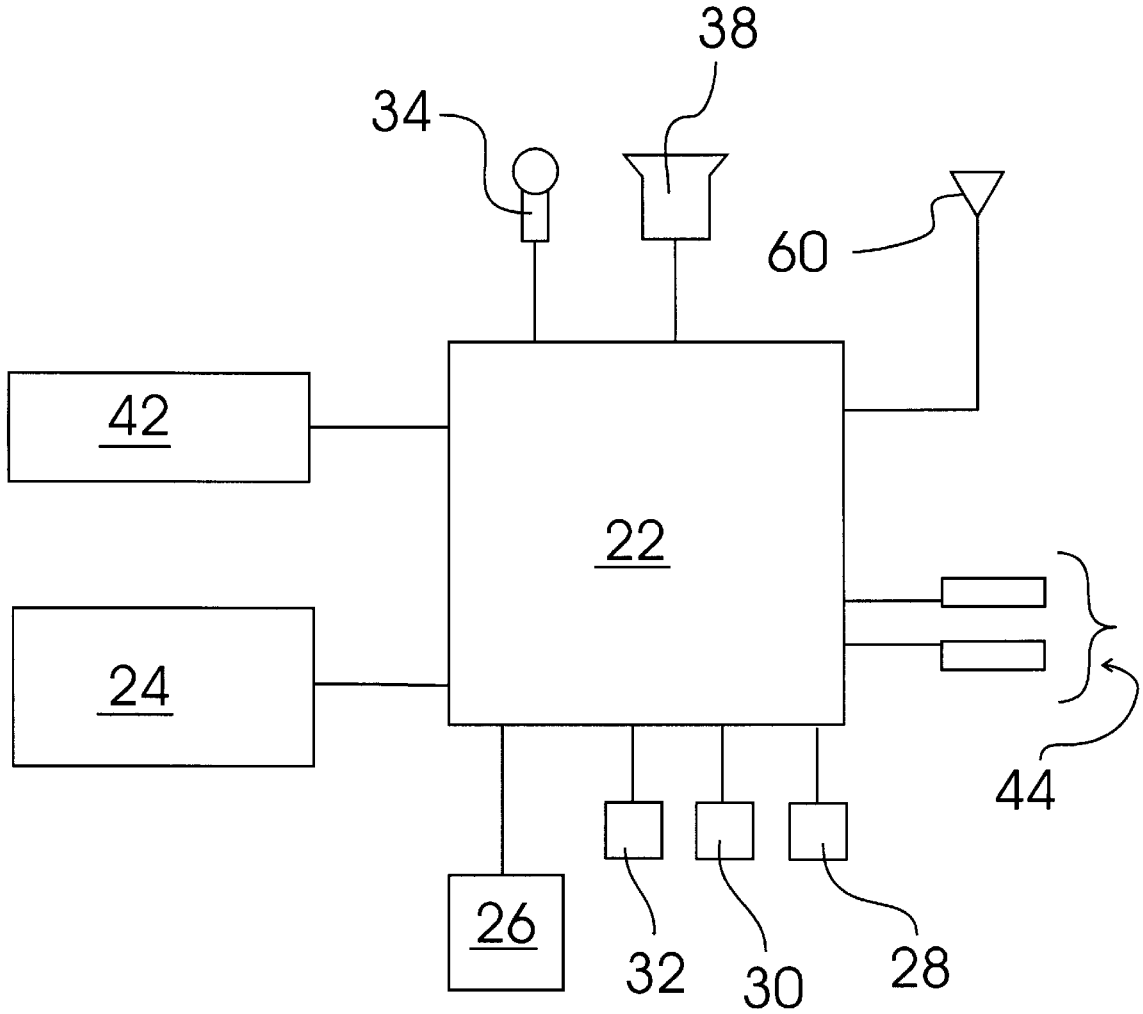
FIG. 3 is a schematic diagram of the transmitter unit of FIG. 2 showing the radio transmitter/control circuit in connecting with the main LCD interface display, the alphanumeric keypad, the scroll-up button, the scroll-down button, the select button, the transmitter microphone, the transmitter speaker, the separate time/date display LCD, the electrical contacts of the recharging connector, and the transmitter antenna.

Referring now to FIG. 3, radio transmitter/microprocessor control circuit 22 includes a transmitter antenna 60 and includes conventional user interface programs that utilize main LCD interface display 24, alphanumeric keypad 26, scroll up button 28, scroll down button 30, and select button 32 to allow the user to select and activate any of the receiver tags 12 (FIG. 1). Microphone 34 is provided to allow user generated messages to be recorded. Transmitter speaker 38 is provided to allow the user to review the messages recorded if desired.

FIG. 4 shows one of the seven identical receiver tags 12 in isolation. As used herein the tern identical means each receiver tag 12 has a different access code and a different exterior identification marking 66 but is otherwise the same. Each receiver tag 12 includes a molded plastic tag housing 70 having a tag clip 72; a tag connecting ring 74; a tag speaker grate 76 behind which is positioned a tag speaker 78 (FIG. 5); a tag microphone grate 80 behind which is positioned a tag microphone 82 (FIG. 5); a diode window 84 behind which is positioned a laser diode 86; a record function button 88; a play function button 90; and a power indicator LED 92 for indicating battery power levels.

Figure 5:
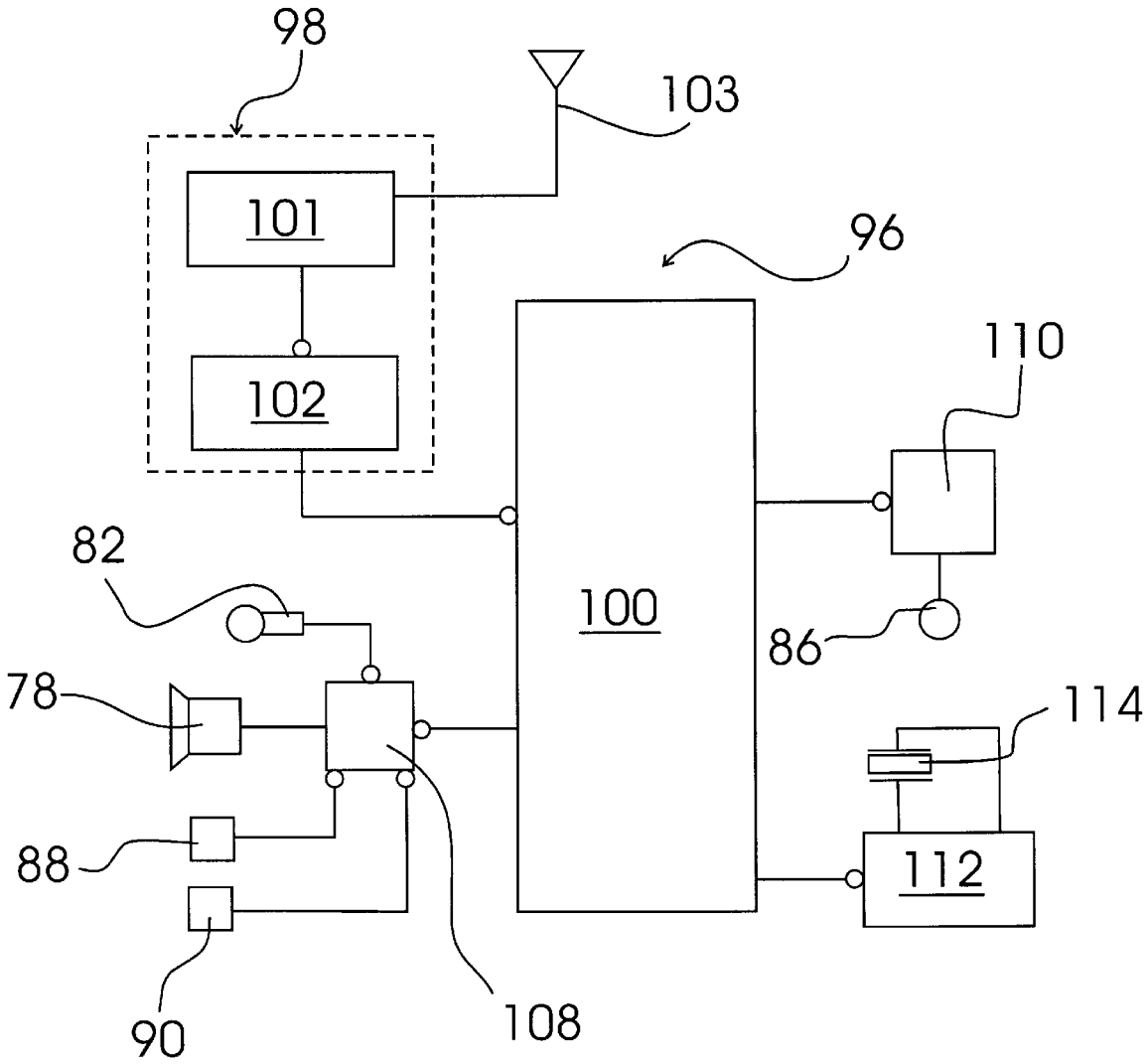
FIG. 5 is a schematic diagram showing the receiver/alerting circuit of the receiver tag of FIG. 4 including the radio receiving circuit in connection with the receiving antenna; the decoding/select circuit in input receiving connection with the receiving circuit output of the receiving circuit; the alerting circuit in receiving connection with alerting circuit activation output of the decoding/select circuit; the audio drive circuit in input receiving connection with the alerting circuit, the record function button, the play function button and the tag microphone, and in output connection with the tag speaker; the laser diode drive circuit in input receiving connection with the alerting circuit and in output connection with the laser diode; and the laser diode movement strcuture drive circuit in driving connection with the piezo crystal of the laser diode movement structure that is positioned between the base substrate and the laser diode support plate.

Molded plastic tag housing 70 also includes an internal compartment formed therein for housing, with reference now to FIG. 5, a receiver/alerting circuit, generally designated 96. Receiver/alerting circuit 96 includes a radio receiving circuit, generally designated 98, and an alerting circuit 100 triggered by an output of the radio receiving circuit 98. Radio receiving circuit 98 has a receiving portion 101 in connection with a receiving antenna 103 and decoding/select circuit 102 tuned to the transmission frequency of radio frequency transmitter circuit of the radio transmitter/control circuit 22 (FIG. 3). Decoding/select circuit 102 decodes the radio transmissions from the radio frequency transmitter circuit of the radio transmitter/control circuit 22 (FIG. 3) and activates alerting circuit 100 a predetermined signal pattern is decoded for that particular receiver tab 12 (FIG. 1). Alerting circuit 100 then activates a tag speaker drive circuit 108 that is in connection with tag speaker 78; a laser diode drive circuit 110 in connection with laser diode 86; and a laser diode movement structure drive circuit 112 including a piezo electric crystal 114. According to preselected choices, tag speaker 78 emits a user recorded message or a predetermined alarm sound.

Referring to FIG. 6, laser diode 86 emits a pinpoint output beam 118 through diode window 84 (FIG. 4) when laser diode drive circuit 110 (FIG. 5) is activated. Laser diode 86 is mounted to a laser diode support plate 120 which is cantilever mounted at one end 122 to a to surface of piezo crystal 114. A bottom surface of piezo crystal 114 is mounted to a base substrate 128. Laser diode support plate 120, piezo crystal 114, and base substrate 128 form the laser diode movement structure, generally designated 130. When laser diode movement structure drive circuit 112 (FIG. 5) is activated, it generates electrical signals to piezo crystal 114 that cause piezo crystal to mechanically vibrate by expanding and contracting. These mechanical vibrations cause laser diode support plate 120 to vibrate resulting in movement of pinpoint output beam 118 of laser diode 86 in a manner to aid a person searching for the article to which the receiver tag 12 (FIG. 1) is attached.

Figure 7:
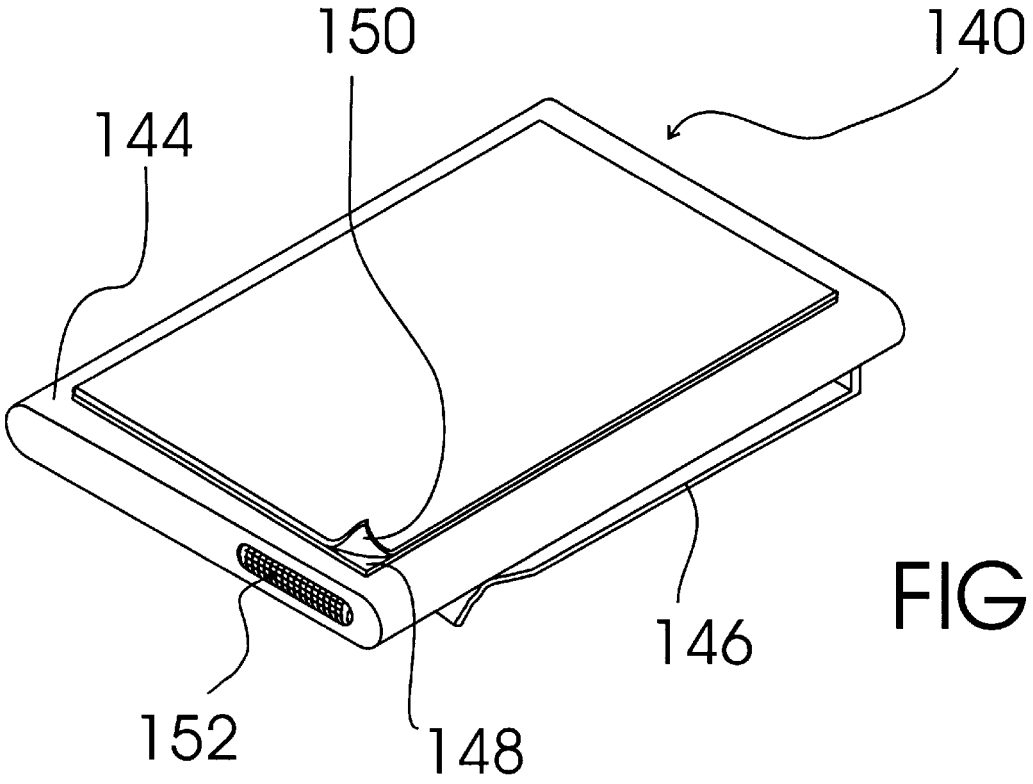
FIG. 7 is a perspective view of an exemplary embodiment of an optional simple receiver tag that is advantageously provided with the article location system of the present invention for use in applications where large numbers of receiver tags are required, such as when the receiver tags are attached to files in an office environment, or in harsh application environments, such as warehouses, where a high risk of destroying the receiver tags makes use of inexpensive receiver tags more desirable; the exemplary simple receiver tag including a slim line housing having an exterior clip, an adhesive section covered by a peel off cover, a speaker grate, and a component compartment housing a radio receiving circuit coupled to a decode/select circuit that activates an audible alerting device housed within the slim line housing and positioned behind the speaker grate.
Figure 8:
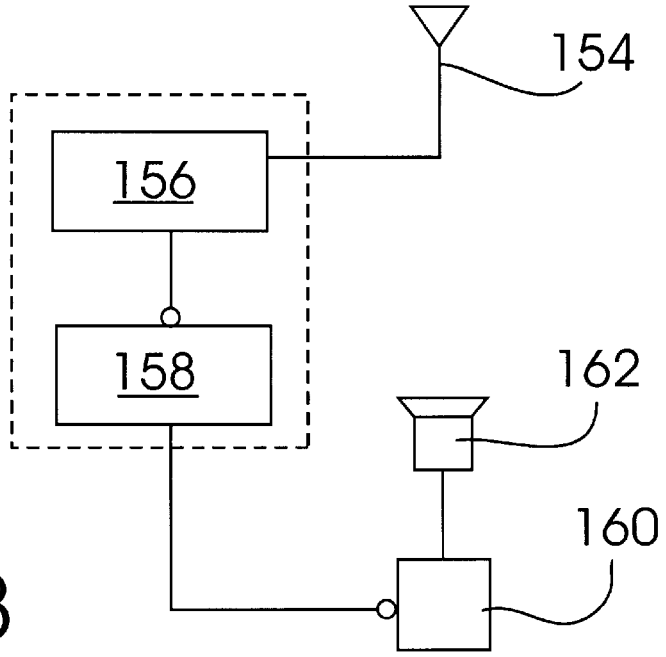
FIG. 8 is a schematic diagram of the exemplary embodiment of the optional simple receiver tag of FIG. 7 showing the receiver antenna, the radio receiving circuit coupled to the decode/select circuit that activates the audible alerting device housed within the slim line housing.

FIG. 7 shows an exemplary embodiment of an optional simple receiver tag, generally designated 140, that is advantageously provided with article location system 10 (FIG. 1) when a large number of items such as file folders are to be tagged or in environments, such as warehouses, where the tags 140 can be easily damaged. Simple receiver tag 140 includes a slim line, molded plastic housing, generally designated 144, including an exterior clip 146 on one side surface thereof, an adhesive section 148 covered by a peel off cover 150 on an opposite side surface thereof, and a speaker grate 152 on one end surface thereof such that speaker grate 152 is not covered whether exterior clip 146 or adhesive section 148 is used to attach simple receiver tag 140 to an article. Slim line, molded plastic hosing 144 has a component compartment formed therein for housing, with reference now to FIG. 8, an antenna 154 in connection with an input of a radio receiving circuit 156 having an output coupled to a decode/select circuit 158. When decode/select circuit 158 detects a predetermined activation code, decode/select circuit 158 activates an audible alerting device 160 that drives a speaker 162 which provides an audible output to assist a searcher in locating the tagged article.

It can be seen from the preceding description that an article location system has been provided that includes a number of identical receiver tags that are attachable to articles and a transmitter assembly including a transmitter unit that transmits a predetermined coded radio signal to activate each receiver tag; each receiver tag providing an audible and a visual output when activated; the visual output including a moving pinpoint output beam generated by a laser diode.

It is noted that the embodiment of the article location system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An article location system comprising:

a number of identical receiver tags;

and a transmitter assembly including a transmitter unit that transmits a predetermined coded radio signal to activate each of said number of receiver tags;

each of said number of receiver tags providing an audible output and a visual output when activated;

said visual output including a moving pinpoint output beam generated by a laser diode;

each of said number of identical receive tags including a laser diode movement structure including a piezo crystal positioned between a base substrate and a laser diode support plate upon which said laser diode is mounted; and a laser diode movement structure drive circuit including said piezo crystal positioned between said base substrate and said laser diode support plate on which said laser diode is mounted such that electrically induced vibrations of said piezo crystal cause said laser diode support plate to vibrate resulting in movement of said pinpoint output beam of the laser diode.

2. An article location system comprising:

a number of identical receiver tags;

and a transmitter assembly including a transmitter unit that transmits a predetermined coded radio signal to activate each of said number of receiver tags;

each of said number of receiver tags providing an audible output and a visual output when activated;

said visual output including a moving pinpoint output beam generated by a laser diode;

said article location further comprising a number of simple receiver tags each including a slim line housing having an exterior clip on one side surface thereof, an adhesive section covered by a peel off cover on an opposite side surface thereof, and a speaker grate provided on one end surface thereof such that said speaker grate is not covered whether said exterior clip or said adhesive section is used to attach a said simple receiver tag to an article;

said slim line housing having a internal compartment formed therein housing an antenna in connection with an input of a radio receiving circuit having an output coupled to a decode/select circuit and an audible alerting device including a speaker;

said decode/select circuit activating said audible alerting device to drive said speaker and provide an audible output in response to detecting a predetermined activation code.

3. An article location system comprising:

a number of identical receiver tags that are attachable to articles; and a transmitter assembly including a transmitter unit that transmits a predetermined coded radio signal to activate each of said number of receiver tags;

each receiver tag providing an audible and a visual output when activated, said visual output including a moving pinpoint output beam generated by a laser diode;

said transmitter unit including a transmitter housing including a radio transmitter/control circuit having a radio frequency transmitter and being in connection with a main LCD interface display, an alphanumeric keypad, a scroll up button, a scroll down button, a select button, a microphone, a transmitter speaker, and a separate time/date display LCD;

said radio transmitter/control circuit being in connection with said main LCD interface display, said alphanumeric keypad, said scroll-up button, said scroll-down button, said select button, said transmitter microphone, said transmitter speaker, said separate time/date display LCD, and said transmitter antenna;

each of said number of identical receiver tags including a molded plastic tag housing a tag clip, a tag connecting ring, a tag speaker grate, a tag microphone grate, a laser diode window, a record function button, and a play function button;

said molded plastic tag housing further including an internal compartment formed therein for housing a receiver/alerting circuit including a radio receiving circuit and an alerting circuit triggered by an output of said radio receiving circuit;

said radio receiving circuit having a decoding/select circuit tuned to said transmission frequency of said radio frequency transmitter circuit of said radio transmitter/control circuit;

said decoding/select circuit decoding said radio transmissions from said radio frequency transmitter circuit of said radio transmitter/control circuit and activating an alerting circuit activation output when a predetermined signal pattern is decoded;

said alerting circuit activating a tag speaker drive circuit in connection with a tag speaker that can emit a user recorded message or a predetermined alarm sound;

a laser diode drive circuit in connection with a laser diode having a pinpoint output beam aimed through a diode window provided in said plastic tag housing;

a laser diode movement structure including a piezo crystal positioned between a base substrate and a laser diode support plate upon which said laser diode is mounted; and a laser diode movement structure drive circuit including said piezo crystal positioned between said base substrate and said laser diode support plate on which said laser diode is mounted such that electrically induced vibrations of said piezo crystal cause said laser diode support plate to vibrate resulting in movement of said pinpoint output beam of said laser diode in a manner to aid a person searching for said article to which said receiver tag is attached to visually identify said location of said receiver tag; said radio receiving circuit being in connection with said receiving antenna;

said decoding/select circuit being in input receiving connection with said receiving circuit output of said receiving circuit;

said alerting circuit being in receiving connection with alerting circuit activation output of said decoding/select circuit;

said audio drive circuit being in input receiving connection with said alerting circuit, said record function button, said play function button and said tag microphone, and in output connection with said tag speaker;

said laser diode drive circuit being in input receiving connection with said alerting circuit and in output connection with said laser diode; and said laser diode movement structure drive circuit being in driving connection with said piezo crystal of said laser diode movement structure that is positioned between said base substrate and said laser diode support plate.

4. The article location system of claim 3 further comprising:

a number of simple receiver tags each including a slim line housing having an exterior clip on one side surface thereof, an adhesive section covered by a peel off cover on an opposite side surface thereof, and a speaker grate provided on one end surface thereof such that said speaker grate is not covered whether said exterior clip or said adhesive section is used to attach a said simple receiver tag to an article;

said slim line housing having a internal compartment formed therein housing an antenna in connection with an input of a radio receiving circuit having an output coupled to a decode/select circuit and an audible alerting device including a speaker;

said decode/select circuit activating said audible alerting device to drive said speaker and provide an audible output in response to detecting a predetermined activation code.

* * * * *